United States Patent [19]

Shier

[11] Patent Number: 4,782,320

[45] Date of Patent: Nov. 1, 1988

[54] MESH NETWORK FOR LASER-TRIMMED INTEGRATED CIRCUIT RESISTORS

[75] Inventor: John S. Shier, Apple Valley, Minn.

[73] Assignee: VTC Incorporated, Bloomington, Minn.

[21] Appl. No.: 926,391

[22] Filed: Nov. 3, 1986

[51] Int. Cl.[4] ..... H01C 7/22

[52] U.S. Cl. ..... 338/295; 29/610.1

[58] Field of Search ..... 338/295, 308, 309, 333, 338/334; 219/121 CH, 121 LJ; 340/347 DA; 29/610 R

[56] References Cited

U.S. PATENT DOCUMENTS

| | | | |
|---|---|---|---|
| 3,388,461 | 6/1968 | Lins | 29/610 R |
| 4,240,094 | 12/1980 | Mader | 357/49 |
| 4,278,706 | 7/1981 | Barry | 427/96 |
| 4,344,064 | 8/1982 | Bitler et al. | 338/334 |
| 4,456,894 | 6/1984 | Lapart | 338/308 X |

*Primary Examiner*—E. A. Goldberg
*Assistant Examiner*—Marvin M. Lateef
*Attorney, Agent, or Firm*—Kinney & Lange

[57] ABSTRACT

A resistor network coupling two terminal leads and adapted to be fabricated on an integrated circuit. A plurality of N-sided meshes are each formed by N resistor elements linked at network nodes. Some of the resistor elements can be cut by a laser under computer control to select a desired resistance value of the network.

6 Claims, 6 Drawing Sheets

| PATTERN NUMBER | RESISTANCE VALUE | % CHANGE | PATTERN CONFIGURATION R1 | R2 | R3 | R4 | R5 | R6 | R7 | R8 | R9 | R10 | R11 | R12 | R13 | R14 | R15 |
|---|---|---|---|---|---|---|---|---|---|---|---|---|---|---|---|---|---|
| 0001 | 1.2381 | 0.0000 | 1 | 1 | 1 | 1 | 1 | 1 | 1 | 1 | 1 | 1 | 1 | 1 | 1 | 1 | 1 |
| 2 | 1.2458 | .6131 | 1 | 1 | 1 | 1 | 1 | 1 | 1 | 1 | 1 | 1 | 1 | 1 | 0 | 1 | 1 |
| 3 | 1.2459 | .0080 | 1 | 1 | 1 | 1 | 1 | 1 | 1 | 1 | 0 | 1 | 1 | 1 | 0 | 1 | 1 |
| 4 | 1.2500 | .3280 | 1 | 1 | 1 | 1 | 1 | 1 | 1 | 1 | 1 | 1 | 1 | 1 | 0 | 0 | 1 |
| 5 | 1.2591 | .7227 | 1 | 1 | 1 | 1 | 1 | 1 | 1 | 1 | 1 | 1 | 0 | 1 | 1 | 1 | 1 |
| 6 | 1.2593 | .0159 | 1 | 1 | 1 | 0 | 1 | 1 | 1 | 1 | 1 | 1 | 0 | 1 | 1 | 1 | 1 |
| 7 | 1.2629 | .2851 | 1 | 1 | 1 | 1 | 1 | 1 | 1 | 1 | 1 | 1 | 0 | 1 | 1 | 0 | 1 |
| 8 | 1.2632 | .0237 | 1 | 1 | 1 | 1 | 1 | 1 | 1 | 1 | 0 | 1 | 0 | 1 | 1 | 1 | 1 |
| 9 | 1.2697 | .5119 | 1 | 1 | 1 | 1 | 1 | 1 | 1 | 1 | 1 | 1 | 1 | 0 | 0 | 1 | 1 |
| 10 | 1.2698 | .0079 | 1 | 1 | 1 | 0 | 1 | 1 | 1 | 1 | 1 | 1 | 1 | 0 | 0 | 1 | 1 |
| 11 | 1.2727 | .2279 | 1 | 1 | 1 | 1 | 1 | 1 | 1 | 1 | 1 | 1 | 0 | 0 | 1 | 1 | 1 |
| 12 | 1.3013 | 2.1978 | 1 | 1 | 1 | 1 | 1 | 1 | 1 | 0 | 1 | 1 | 1 | 1 | 1 | 1 | 1 |
| 13 | 1.3014 | .0077 | 1 | 1 | 1 | 1 | 1 | 1 | 1 | 0 | 1 | 1 | 0 | 1 | 1 | 1 | 1 |
| 14 | 1.3022 | .0614 | 1 | 1 | 1 | 0 | 1 | 1 | 1 | 0 | 1 | 1 | 1 | 1 | 1 | 1 | 1 |
| 15 | 1.3023 | .0077 | 1 | 1 | 1 | 0 | 1 | 1 | 1 | 0 | 1 | 1 | 0 | 1 | 1 | 1 | 1 |
| 16 | 1.3030 | .0537 | 1 | 1 | 1 | 0 | 1 | 1 | 1 | 0 | 1 | 1 | 1 | 1 | 1 | 0 | 1 |
| 17 | 1.3036 | .0460 | 1 | 1 | 1 | 1 | 1 | 1 | 1 | 1 | 1 | 0 | 1 | 1 | 0 | 1 | 1 |
| 18 | 1.3043 | .0537 | 1 | 1 | 1 | 0 | 1 | 1 | 1 | 1 | 1 | 0 | 1 | 1 | 0 | 1 | 1 |
| 19 | 1.3131 | .6702 | 1 | 1 | 1 | 1 | 1 | 1 | 1 | 1 | 1 | 0 | 0 | 1 | 1 | 1 | 1 |
| 20 | 1.3134 | .0228 | 1 | 1 | 1 | 0 | 1 | 1 | 1 | 1 | 1 | 0 | 0 | 1 | 1 | 1 | 1 |
| 21 | 1.3140 | .0457 | 1 | 1 | 1 | 1 | 1 | 1 | 1 | 0 | 1 | 1 | 0 | 0 | 1 | 1 | 1 |
| 22 | 1.3143 | .0228 | 1 | 1 | 1 | 0 | 1 | 1 | 1 | 0 | 1 | 1 | 0 | 0 | 1 | 1 | 1 |
| 23 | 1.3190 | .3563 | 1 | 1 | 1 | 1 | 1 | 1 | 1 | 1 | 1 | 0 | 0 | 1 | 1 | 0 | 1 |
| 24 | 1.3191 | .0076 | 1 | 1 | 1 | 0 | 1 | 1 | 1 | 1 | 1 | 0 | 0 | 1 | 1 | 0 | 1 |
| 25 | 1.3333 | 1.0650 | 1 | 1 | 1 | 1 | 1 | 1 | 1 | 0 | 0 | 1 | 1 | 1 | 1 | 1 | 1 |
| 26 | 1.3695 | 2.6433 | 1 | 1 | 1 | 1 | 1 | 0 | 1 | 1 | 1 | 1 | 1 | 1 | 1 | 1 | 1 |
| 27 | 1.3704 | .0657 | 1 | 1 | 1 | 1 | 1 | 0 | 1 | 1 | 1 | 1 | 1 | 1 | 1 | 0 | 1 |
| 28 | 1.3836 | .9540 | 1 | 1 | 1 | 1 | 1 | 1 | 0 | 1 | 1 | 1 | 1 | 1 | 0 | 1 | 1 |
| 29 | 1.3930 | .6748 | 1 | 1 | 1 | 0 | 1 | 0 | 1 | 1 | 1 | 1 | 1 | 1 | 1 | 1 | 1 |
| 30 | 1.3939 | .0646 | 1 | 1 | 1 | 1 | 1 | 0 | 1 | 1 | 1 | 1 | 1 | 1 | 0 | 1 | 1 |
| 31 | 1.3947 | .0574 | 1 | 1 | 1 | 1 | 1 | 0 | 1 | 1 | 0 | 1 | 1 | 1 | 1 | 1 | 1 |
| 32 | 1.3795 | .1861 | 1 | 1 | 1 | 1 | 1 | 1 | 0 | 1 | 1 | 1 | 0 | 1 | 1 | 1 | 1 |
| 33 | 1.3987 | .1001 | 1 | 1 | 1 | 1 | 1 | 1 | 0 | 1 | 1 | 1 | 0 | 1 | 1 | 0 | 1 |
| 34 | 1.4000 | .0929 | 1 | 1 | 1 | 1 | 1 | 0 | 1 | 1 | 1 | 1 | 1 | 1 | 0 | 0 | 1 |
| 35 | 1.4074 | .5258 | 1 | 1 | 1 | 0 | 1 | 1 | 0 | 1 | 1 | 1 | 1 | 1 | 0 | 1 | 1 |
| 36 | 1.4167 | .6565 | 1 | 1 | 1 | 1 | 1 | 0 | 1 | 1 | 0 | 1 | 1 | 1 | 0 | 1 | 1 |
| 37 | 1.4177 | .0705 | 1 | 1 | 1 | 0 | 1 | 1 | 0 | 1 | 1 | 1 | 0 | 1 | 1 | 1 | 1 |
| 38 | 1.4182 | .0353 | 1 | 1 | 1 | 0 | 1 | 1 | 0 | 1 | 1 | 1 | 0 | 1 | 1 | 0 | 1 |
| 39 | 1.4231 | .3443 | 1 | 1 | 1 | 0 | 1 | 0 | 1 | 1 | 1 | 1 | 1 | 1 | 0 | 1 | 1 |
| 40 | 1.4286 | .3850 | 1 | 1 | 1 | 1 | 1 | 0 | 1 | 1 | 1 | 1 | 1 | 0 | 0 | 1 | 1 |
| 41 | 1.4545 | 1.7807 | 1 | 1 | 1 | 1 | 1 | 0 | 0 | 1 | 1 | 1 | 1 | 1 | 1 | 1 | 1 |
| 42 | 1.4535 | .6150 | 1 | 1 | 1 | 1 | 1 | 0 | 1 | 1 | 1 | 1 | 0 | 1 | 1 | 1 | 1 |
| 43 | 1.4650 | .1024 | 1 | 1 | 1 | 1 | 1 | 1 | 0 | 0 | 1 | 1 | 1 | 1 | 1 | 1 | 1 |
| 44 | 1.4659 | .0614 | 1 | 1 | 1 | 1 | 1 | 1 | 0 | 0 | 1 | 1 | 0 | 1 | 1 | 1 | 1 |
| 45 | 1.4687 | .1906 | 1 | 1 | 1 | 1 | 1 | 0 | 1 | 1 | 0 | 1 | 1 | 0 | 1 | 1 | 1 |
| 46 | 1.4688 | .0068 | 1 | 1 | 1 | 1 | 1 | 0 | 1 | 1 | 0 | 1 | 0 | 1 | 1 | 1 | 1 |
| 47 | 1.4701 | .0884 | 1 | 1 | 1 | 1 | 1 | 1 | 0 | 0 | 1 | 1 | 1 | 1 | 1 | 0 | 1 |
| 48 | 1.4747 | .3119 | 1 | 1 | 1 | 1 | 1 | 0 | 1 | 1 | 1 | 1 | 0 | 0 | 1 | 1 | 1 |
| 49 | 1.4783 | .2435 | 1 | 1 | 1 | 1 | 1 | 0 | 1 | 1 | 1 | 0 | 1 | 1 | 0 | 1 | 1 |
| 50 | 1.4823 | .3035 | 1 | 1 | 1 | 0 | 1 | 1 | 0 | 0 | 1 | 1 | 1 | 1 | 1 | 1 | 1 |
| 51 | 1.4836 | .0539 | 1 | 1 | 1 | 1 | 1 | 0 | 0 | 1 | 1 | 1 | 1 | 1 | 0 | 1 | 1 |
| 52 | 1.4839 | .0202 | 1 | 1 | 1 | 0 | 1 | 1 | 0 | 0 | 1 | 1 | 0 | 1 | 1 | 1 | 1 |

Fig. 3A

| PATTERN NUMBER | RESISTANCE VALUE | % CHANGE | PATTERN CONFIGURATION R 1 | R 2 | R 3 | R 4 | R 5 | R 6 | R 7 | R 8 | R 9 | R 10 | R 11 | R 12 | R 13 | R 14 | R 15 |
|---|---|---|---|---|---|---|---|---|---|---|---|---|---|---|---|---|---|
| 53 | 1.4894 | .3693 | 1 | 1 | 1 | 0 | 1 | 1 | 0 | 0 | 1 | 1 | 1 | 1 | 1 | 0 | 1 |
| 54 | 1.4909 | .1006 | 1 | 1 | 1 | 1 | 1 | 1 | 0 | 1 | 1 | 1 | 1 | 0 | 0 | 1 | 1 |
| 55 | 1.5000 | .6067 | 1 | 1 | 1 | 1 | 1 | 0 | 1 | 1 | 0 | 1 | 0 | 0 | 1 | 1 | 1 |
| 56 | 1.5236 | 1.5619 | 1 | 1 | 1 | 0 | 1 | 0 | 1 | 1 | 1 | 1 | 0 | 1 | 1 | 1 | 1 |
| 57 | 1.5294 | .3662 | 1 | 1 | 1 | 0 | 1 | 0 | 1 | 1 | 1 | 1 | 0 | 0 | 1 | 1 | 1 |
| 58 | 1.5417 | .7978 | 1 | 1 | 1 | 1 | 1 | 0 | 1 | 1 | 1 | 0 | 0 | 1 | 1 | 1 | 1 |
| 59 | 1.5443 | .1684 | 1 | 1 | 1 | 1 | 1 | 0 | 0 | 1 | 1 | 1 | 0 | 1 | 1 | 1 | 1 |
| 60 | 1.5484 | .2648 | 1 | 1 | 1 | 1 | 1 | 1 | 0 | 0 | 1 | 1 | 0 | 0 | 1 | 1 | 1 |
| 61 | 1.5556 | .4628 | 1 | 1 | 1 | 0 | 1 | 0 | 0 | 1 | 1 | 1 | 0 | 1 | 1 | 1 | 1 |
| 62 | 1.5686 | .8288 | 1 | 1 | 1 | 1 | 1 | 0 | 0 | 1 | 1 | 1 | 0 | 1 | 1 | 0 | 1 |
| 63 | 1.5897 | 1.3273 | 1 | 1 | 1 | 0 | 1 | 0 | 1 | 1 | 1 | 0 | 0 | 1 | 1 | 1 | 1 |
| 64 | 1.5909 | .0754 | 1 | 1 | 1 | 1 | 1 | 0 | 0 | 1 | 1 | 1 | 1 | 0 | 0 | 1 | 1 |
| 65 | 1.6000 | .5688 | 1 | 1 | 1 | 1 | 1 | 0 | 0 | 1 | 1 | 1 | 0 | 0 | 1 | 1 | 1 |
| 66 | 1.6667 | 4.0019 | 1 | 1 | 1 | 0 | 1 | 0 | 1 | 1 | 1 | 0 | 0 | 1 | 1 | 0 | 1 |
| 67 | 1.7303 | 3.6757 | 1 | 1 | 0 | 1 | 1 | 1 | 1 | 1 | 1 | 1 | 1 | 1 | 1 | 1 | 1 |
| 68 | 1.7306 | .0173 | 1 | 1 | 0 | 1 | 1 | 1 | 1 | 1 | 1 | 1 | 0 | 1 | 1 | 1 | 1 |
| 69 | 1.7306 | .0116 | 1 | 1 | 0 | 1 | 1 | 1 | 1 | 1 | 1 | 1 | 1 | 1 | 0 | 1 | 1 |
| 70 | 1.7321 | .0751 | 1 | 1 | 0 | 1 | 1 | 0 | 1 | 1 | 1 | 1 | 1 | 1 | 1 | 1 | 1 |
| 71 | 1.7326 | .0289 | 1 | 1 | 1 | 1 | 0 | 1 | 1 | 1 | 1 | 1 | 1 | 0 | 0 | 1 | 1 |
| 72 | 1.7333 | .0404 | 1 | 1 | 1 | 1 | 0 | 1 | 0 | 1 | 1 | 1 | 1 | 1 | 0 | 1 | 1 |
| 73 | 1.7377 | .2532 | 1 | 1 | 0 | 1 | 1 | 1 | 1 | 1 | 0 | 1 | 1 | 1 | 1 | 1 | 1 |
| 74 | 1.7386 | .0518 | 1 | 1 | 1 | 1 | 0 | 1 | 0 | 1 | 1 | 1 | 0 | 1 | 1 | 1 | 1 |
| 75 | 1.7391 | .0288 | 1 | 1 | 0 | 1 | 1 | 0 | 1 | 1 | 1 | 1 | 0 | 0 | 1 | 1 | 1 |
| 76 | 1.7407 | .0919 | 1 | 1 | 0 | 1 | 1 | 1 | 1 | 1 | 0 | 1 | 0 | 1 | 1 | 1 | 1 |
| 77 | 1.7419 | .0689 | 1 | 1 | 0 | 1 | 1 | 1 | 1 | 1 | 0 | 1 | 0 | 0 | 1 | 1 | 1 |
| 78 | 1.7500 | .4629 | 1 | 1 | 1 | 1 | 0 | 1 | 1 | 0 | 1 | 1 | 1 | 1 | 1 | 1 | 1 |
| 79 | 1.8158 | 3.6237 | 1 | 1 | 1 | 1 | 0 | 0 | 1 | 1 | 1 | 1 | 1 | 1 | 1 | 1 | 1 |
| 80 | 1.8175 | .0935 | 1 | 1 | 0 | 1 | 1 | 1 | 0 | 1 | 1 | 1 | 0 | 1 | 1 | 1 | 1 |
| 81 | 1.8182 | .0385 | 1 | 1 | 0 | 1 | 1 | 1 | 0 | 1 | 1 | 1 | 1 | 1 | 0 | 1 | 1 |
| 82 | 1.8256 | .4053 | 1 | 1 | 0 | 1 | 1 | 0 | 0 | 1 | 1 | 1 | 1 | 1 | 1 | 1 | 1 |
| 83 | 1.8261 | .0274 | 1 | 1 | 0 | 1 | 1 | 0 | 0 | 1 | 1 | 1 | 0 | 1 | 1 | 1 | 1 |
| 84 | 1.8286 | .1367 | 1 | 1 | 1 | 1 | 0 | 0 | 1 | 1 | 1 | 1 | 1 | 0 | 0 | 1 | 1 |
| 85 | 1.8333 | .2564 | 1 | 1 | 1 | 1 | 0 | 0 | 0 | 1 | 1 | 1 | 1 | 1 | 0 | 1 | 1 |
| 86 | 1.8636 | 1.6259 | 1 | 1 | 1 | 1 | 0 | 0 | 1 | 1 | 0 | 1 | 1 | 1 | 1 | 1 | 1 |
| 87 | 1.8710 | .3955 | 1 | 1 | 1 | 1 | 0 | 0 | 0 | 1 | 1 | 1 | 0 | 1 | 1 | 1 | 1 |
| 88 | 1.8750 | .2133 | 1 | 1 | 0 | 1 | 1 | 0 | 0 | 1 | 1 | 1 | 0 | 0 | 1 | 1 | 1 |
| 89 | 1.8889 | .7359 | 1 | 1 | 1 | 1 | 0 | 0 | 1 | 1 | 0 | 1 | 0 | 1 | 1 | 1 | 1 |
| 90 | 1.9000 | .5842 | 1 | 1 | 1 | 1 | 0 | 0 | 1 | 1 | 0 | 1 | 0 | 0 | 1 | 1 | 1 |
| 91 | 2.0000 | 5.0000 | 1 | 1 | 0 | 0 | 1 | 1 | 1 | 1 | 1 | 1 | 1 | 1 | 1 | 1 | 1 |
| 92 | 2.5379 | 21.1947 | 0 | 1 | 1 | 1 | 1 | 1 | 1 | 1 | 1 | 1 | 1 | 1 | 1 | 1 | 1 |
| 93 | 2.5387 | .0315 | 0 | 1 | 1 | 1 | 1 | 1 | 1 | 1 | 1 | 1 | 1 | 1 | 1 | 0 | 1 |
| 94 | 2.5574 | .7312 | 0 | 1 | 1 | 1 | 1 | 1 | 1 | 1 | 0 | 1 | 1 | 1 | 1 | 1 | 1 |
| 95 | 2.5646 | .2807 | 0 | 1 | 1 | 1 | 1 | 1 | 1 | 1 | 1 | 1 | 1 | 1 | 0 | 1 | 1 |
| 96 | 2.5769 | .4773 | 1 | 0 | 1 | 1 | 1 | 1 | 1 | 1 | 1 | 1 | 1 | 1 | 0 | 1 | 1 |
| 97 | 2.5893 | .4789 | 0 | 1 | 1 | 1 | 1 | 1 | 1 | 1 | 1 | 1 | 1 | 1 | 0 | 0 | 1 |
| 98 | 2.5909 | .0618 | 0 | 1 | 1 | 1 | 1 | 1 | 1 | 1 | 0 | 1 | 1 | 1 | 0 | 1 | 1 |
| 99 | 2.5967 | .2234 | 0 | 1 | 1 | 1 | 1 | 1 | 1 | 1 | 1 | 1 | 0 | 1 | 1 | 1 | 1 |
| 100 | 2.6019 | .1999 | 0 | 1 | 1 | 1 | 1 | 1 | 1 | 1 | 1 | 1 | 0 | 1 | 1 | 0 | 1 |
| 101 | 2.6087 | .2607 | 0 | 1 | 1 | 1 | 1 | 1 | 1 | 1 | 0 | 1 | 1 | 1 | 0 | 0 | 1 |
| 102 | 2.6477 | 1.4730 | 1 | 0 | 1 | 1 | 1 | 1 | 1 | 1 | 1 | 1 | 1 | 0 | 0 | 1 | 1 |
| 103 | 2.6667 | .7125 | 1 | 0 | 1 | 1 | 1 | 1 | 1 | 1 | 1 | 1 | 0 | 1 | 1 | 1 | 1 |
| 104 | 2.6967 | 1.1125 | 0 | 1 | 1 | 1 | 1 | 1 | 1 | 1 | 1 | 1 | 0 | 0 | 1 | 1 | 1 |

Fig. 3B

| PATTERN NUMBER | RESISTANCE VALUE | % CHANGE | PATTERN CONFIGURATION R 1 | R 2 | R 3 | R 4 | R 5 | R 6 | R 7 | R 8 | R 9 | R 10 | R 11 | R 12 | R 13 | R 14 | R 15 |
|---|---|---|---|---|---|---|---|---|---|---|---|---|---|---|---|---|---|
| 105 | 2.7019 | .1925 | 1 | 0 | 1 | 1 | 1 | 1 | 1 | 1 | 1 | 1 | 0 | 1 | 1 | 0 | 1 |
| 106 | 2.7093 | .2731 | 0 | 1 | 1 | 1 | 1 | 1 | 1 | 1 | 1 | 1 | 1 | 0 | 0 | 1 | 1 |
| 107 | 2.7097 | .0148 | 0 | 1 | 1 | 1 | 1 | 1 | 1 | 1 | 0 | 1 | 0 | 0 | 1 | 1 | 1 |
| 108 | 2.7321 | .8199 | 0 | 1 | 1 | 1 | 1 | 1 | 1 | 0 | 1 | 1 | 1 | 1 | 1 | 1 | 1 |
| 109 | 2.7333 | .0439 | 0 | 1 | 1 | 1 | 1 | 1 | 1 | 0 | 1 | 1 | 0 | 1 | 1 | 1 | 1 |
| 110 | 2.7391 | .2117 | 0 | 1 | 1 | 1 | 1 | 1 | 1 | 0 | 1 | 1 | 1 | 1 | 1 | 0 | 1 |
| 111 | 2.7500 | .3964 | 1 | 0 | 1 | 1 | 1 | 1 | 1 | 1 | 1 | 0 | 1 | 1 | 0 | 1 | 1 |
| 112 | 2.7697 | .7113 | 0 | 1 | 1 | 1 | 1 | 0 | 1 | 1 | 1 | 1 | 1 | 1 | 1 | 1 | 1 |
| 113 | 2.7698 | .0036 | 0 | 1 | 1 | 1 | 1 | 0 | 1 | 1 | 1 | 1 | 1 | 1 | 1 | 0 | 1 |
| 114 | 2.7727 | .1046 | 0 | 1 | 1 | 1 | 1 | 0 | 1 | 1 | 0 | 1 | 1 | 1 | 1 | 1 | 1 |
| 115 | 2.8261 | 1.8895 | 1 | 0 | 1 | 1 | 1 | 1 | 1 | 1 | 1 | 0 | 0 | 1 | 1 | 1 | 1 |
| 116 | 2.8295 | .1202 | 1 | 0 | 1 | 1 | 1 | 1 | 0 | 1 | 1 | 1 | 1 | 1 | 0 | 1 | 1 |
| 117 | 2.8333 | .1341 | 0 | 1 | 1 | 1 | 1 | 1 | 1 | 0 | 1 | 1 | 0 | 0 | 1 | 1 | 1 |
| 118 | 2.8372 | .1375 | 0 | 1 | 1 | 1 | 1 | 0 | 1 | 1 | 1 | 1 | 1 | 1 | 0 | 1 | 1 |
| 119 | 2.8387 | .0523 | 0 | 1 | 1 | 1 | 1 | 0 | 1 | 1 | 0 | 1 | 1 | 1 | 0 | 1 | 1 |
| 120 | 2.8696 | 1.0768 | 0 | 1 | 1 | 1 | 1 | 0 | 1 | 1 | 1 | 1 | 1 | 1 | 0 | 0 | 1 |
| 121 | 2.8750 | .1878 | 1 | 0 | 1 | 1 | 1 | 1 | 1 | 1 | 1 | 0 | 0 | 1 | 1 | 0 | 1 |
| 122 | 2.9282 | 1.8168 | 1 | 0 | 1 | 1 | 1 | 1 | 1 | 0 | 1 | 1 | 1 | 1 | 1 | 1 | 1 |
| 123 | 2.9286 | .0137 | 1 | 0 | 1 | 1 | 1 | 1 | 0 | 1 | 1 | 1 | 0 | 1 | 1 | 1 | 1 |
| 124 | 2.9302 | .0546 | 1 | 0 | 1 | 1 | 1 | 1 | 1 | 0 | 1 | 1 | 1 | 1 | 1 | 0 | 1 |
| 125 | 2.9333 | .1057 | 0 | 1 | 1 | 1 | 1 | 1 | 1 | 1 | 1 | 0 | 1 | 1 | 0 | 1 | 1 |
| 126 | 2.9545 | .7175 | 0 | 1 | 1 | 1 | 1 | 1 | 1 | 1 | 1 | 0 | 0 | 1 | 1 | 1 | 1 |
| 127 | 2.9565 | .0676 | 1 | 0 | 1 | 1 | 1 | 1 | 1 | 0 | 1 | 1 | 0 | 0 | 1 | 1 | 1 |
| 128 | 2.9677 | .3774 | 0 | 1 | 1 | 1 | 1 | 1 | 1 | 1 | 1 | 0 | 0 | 1 | 1 | 0 | 1 |
| 129 | 2.9909 | .7757 | 0 | 1 | 1 | 1 | 1 | 0 | 1 | 1 | 1 | 1 | 0 | 1 | 1 | 1 | 1 |
| 130 | 3.0000 | .3033 | 0 | 1 | 1 | 1 | 1 | 1 | 1 | 0 | 0 | 1 | 1 | 1 | 1 | 1 | 1 |
| 131 | 3.0286 | .9443 | 0 | 1 | 1 | 1 | 1 | 0 | 1 | 1 | 1 | 1 | 1 | 0 | 0 | 1 | 1 |
| 132 | 3.0556 | .8836 | 0 | 1 | 1 | 1 | 1 | 0 | 1 | 1 | 1 | 1 | 0 | 1 | 1 | 0 | 1 |
| 133 | 3.0909 | 1.1421 | 0 | 1 | 1 | 1 | 1 | 0 | 1 | 1 | 1 | 1 | 0 | 0 | 1 | 1 | 1 |
| 134 | 3.0968 | .1905 | 1 | 0 | 1 | 1 | 1 | 1 | 0 | 1 | 1 | 1 | 1 | 0 | 0 | 1 | 1 |
| 135 | 3.1000 | .1032 | 0 | 1 | 1 | 1 | 1 | 0 | 1 | 1 | 0 | 1 | 0 | 0 | 1 | 1 | 1 |
| 136 | 3.2500 | 4.6154 | 0 | 0 | 1 | 1 | 1 | 1 | 1 | 1 | 1 | 1 | 1 | 1 | 1 | 1 | 1 |
| 137 | 3.3023 | 1.5837 | 1 | 0 | 1 | 1 | 1 | 1 | 0 | 0 | 1 | 1 | 1 | 1 | 1 | 1 | 1 |
| 138 | 3.3036 | .0394 | 0 | 0 | 1 | 1 | 1 | 1 | 1 | 1 | 1 | 1 | 1 | 1 | 0 | 1 | 1 |
| 139 | 3.3043 | .0212 | 1 | 0 | 1 | 1 | 1 | 1 | 0 | 0 | 1 | 1 | 0 | 1 | 1 | 1 | 1 |
| 140 | 3.3143 | .3017 | 1 | 0 | 1 | 1 | 1 | 1 | 0 | 0 | 1 | 1 | 1 | 1 | 1 | 0 | 1 |
| 141 | 3.3333 | .5700 | 0 | 1 | 1 | 1 | 1 | 0 | 1 | 1 | 1 | 0 | 1 | 1 | 0 | 1 | 1 |
| 142 | 3.4000 | 1.9618 | 0 | 0 | 1 | 1 | 1 | 1 | 1 | 1 | 1 | 1 | 0 | 1 | 1 | 1 | 1 |
| 143 | 3.4286 | .8342 | 0 | 0 | 1 | 1 | 1 | 1 | 1 | 1 | 0 | 1 | 0 | 1 | 1 | 1 | 1 |
| 144 | 3.4783 | 1.4289 | 0 | 0 | 1 | 1 | 1 | 1 | 1 | 1 | 1 | 1 | 1 | 0 | 0 | 1 | 1 |
| 145 | 3.4839 | .1607 | 0 | 1 | 1 | 1 | 1 | 0 | 1 | 1 | 1 | 0 | 0 | 1 | 1 | 1 | 1 |
| 146 | 3.5000 | .4600 | 0 | 0 | 1 | 1 | 1 | 1 | 1 | 1 | 1 | 1 | 0 | 0 | 1 | 1 | 1 |
| 147 | 3.6000 | 2.7778 | 0 | 1 | 1 | 1 | 1 | 0 | 1 | 1 | 1 | 0 | 0 | 1 | 1 | 0 | 1 |
| 148 | 3.7083 | 2.9205 | 0 | 1 | 0 | 1 | 1 | 1 | 1 | 1 | 1 | 1 | 1 | 1 | 1 | 1 | 1 |
| 149 | 3.7125 | .1131 | 0 | 1 | 0 | 1 | 1 | 1 | 1 | 1 | 1 | 1 | 0 | 1 | 1 | 1 | 1 |
| 150 | 3.7143 | .0485 | 0 | 1 | 0 | 1 | 1 | 1 | 1 | 1 | 1 | 1 | 1 | 1 | 0 | 1 | 1 |
| 151 | 3.7321 | .4769 | 0 | 1 | 0 | 1 | 1 | 0 | 1 | 1 | 1 | 1 | 1 | 1 | 1 | 1 | 1 |
| 152 | 3.7333 | .0321 | 0 | 1 | 0 | 1 | 1 | 0 | 1 | 1 | 1 | 1 | 0 | 1 | 1 | 1 | 1 |
| 153 | 3.7391 | .1551 | 1 | 0 | 1 | 1 | 0 | 1 | 1 | 1 | 1 | 1 | 1 | 0 | 0 | 1 | 1 |
| 154 | 3.7300 | .2907 | 1 | 0 | 1 | 1 | 0 | 1 | 0 | 1 | 1 | 1 | 1 | 1 | 0 | 1 | 1 |
| 155 | 3.8125 | 1.6393 | 0 | 1 | 0 | 1 | 1 | 1 | 1 | 1 | 0 | 1 | 1 | 1 | 1 | 1 | 1 |
| 156 | 3.8261 | .3555 | 1 | 0 | 1 | 1 | 0 | 1 | 0 | 1 | 1 | 1 | 0 | 1 | 1 | 1 | 1 |

Fig. 3C

| PATTERN NUMBER | RESISTANCE VALUE | % CHANGE | PATTERN CONFIGURATION R1 | R2 | R3 | R4 | R5 | R6 | R7 | R8 | R9 | R10 | R11 | R12 | R13 | R14 | R15 |
|---|---|---|---|---|---|---|---|---|---|---|---|---|---|---|---|---|---|
| 157 | 3.8333 | .1873 | 0 | 1 | 0 | 1 | 1 | 0 | 1 | 1 | 1 | 1 | 0 | 0 | 1 | 1 | 1 |
| 158 | 3.8571 | .6170 | 0 | 1 | 0 | 1 | 1 | 1 | 1 | 1 | 0 | 1 | 0 | 1 | 1 | 1 | 1 |
| 159 | 3.8750 | .4619 | 0 | 1 | 0 | 1 | 1 | 1 | 1 | 1 | 0 | 1 | 0 | 0 | 1 | 1 | 1 |
| 160 | 4.0000 | 3.1250 | 1 | 0 | 1 | 1 | 0 | 1 | 1 | 0 | 1 | 1 | 1 | 1 | 1 | 1 | 1 |
| 161 | 4.0287 | .7124 | 1 | 0 | 1 | 1 | 1 | 0 | 1 | 1 | 1 | 1 | 1 | 1 | 1 | 1 | 1 |
| 162 | 4.0581 | .7245 | 1 | 0 | 1 | 1 | 1 | 0 | 1 | 1 | 1 | 1 | 1 | 1 | 1 | 0 | 1 |
| 163 | 4.0930 | .8527 | 0 | 1 | 1 | 1 | 1 | 0 | 0 | 1 | 1 | 1 | 1 | 1 | 1 | 1 | 1 |
| 164 | 4.1143 | .5177 | 0 | 1 | 1 | 1 | 1 | 0 | 0 | 1 | 1 | 1 | 1 | 1 | 1 | 0 | 1 |
| 165 | 4.1500 | .8602 | 0 | 1 | 1 | 1 | 1 | 1 | 0 | 1 | 1 | 1 | 1 | 1 | 0 | 1 | 1 |
| 166 | 4.1932 | 1.0302 | 0 | 1 | 1 | 1 | 1 | 1 | 0 | 1 | 1 | 1 | 0 | 1 | 1 | 1 | 1 |
| 167 | 4.1935 | .0072 | 0 | 1 | 1 | 1 | 1 | 1 | 0 | 1 | 1 | 1 | 0 | 1 | 1 | 0 | 1 |
| 168 | 4.1936 | .0024 | 1 | 0 | 1 | 1 | 1 | 0 | 1 | 1 | 1 | 1 | 1 | 0 | 1 | 0 | 1 |
| 169 | 4.2500 | 1.3271 | 0 | 1 | 1 | 1 | 1 | 0 | 0 | 1 | 1 | 1 | 1 | 1 | 0 | 1 | 1 |
| 170 | 4.3571 | 2.4581 | 1 | 0 | 1 | 1 | 1 | 0 | 1 | 1 | 1 | 1 | 1 | 1 | 0 | 1 | 1 |
| 171 | 4.3871 | .6838 | 0 | 1 | 1 | 1 | 1 | 0 | 0 | 1 | 1 | 1 | 0 | 1 | 1 | 1 | 1 |
| 172 | 4.4000 | .2932 | 0 | 1 | 1 | 1 | 1 | 0 | 0 | 1 | 1 | 1 | 0 | 1 | 1 | 0 | 1 |
| 173 | 4.4348 | .7847 | 1 | 0 | 1 | 1 | 1 | 0 | 0 | 1 | 1 | 1 | 1 | 1 | 0 | 1 | 1 |
| 174 | 4.5000 | 1.4489 | 0 | 1 | 1 | 1 | 1 | 0 | 0 | 1 | 1 | 1 | 1 | 1 | 0 | 0 | 1 |
| 175 | 4.5893 | 1.9458 | 0 | 0 | 1 | 1 | 1 | 0 | 1 | 1 | 1 | 1 | 1 | 1 | 1 | 1 | 1 |
| 176 | 4.6087 | .4209 | 1 | 0 | 1 | 1 | 1 | 0 | 1 | 1 | 1 | 1 | 1 | 0 | 0 | 1 | 1 |
| 177 | 4.7333 | 2.6324 | 0 | 1 | 1 | 1 | 1 | 1 | 0 | 0 | 1 | 1 | 1 | 1 | 1 | 1 | 1 |
| 178 | 4.7500 | .3516 | 0 | 1 | 1 | 1 | 1 | 1 | 0 | 0 | 1 | 1 | 0 | 1 | 1 | 1 | 1 |
| 179 | 4.8333 | 1.7235 | 0 | 1 | 1 | 1 | 1 | 1 | 0 | 0 | 1 | 1 | 1 | 1 | 1 | 0 | 1 |
| 180 | 4.8696 | .7454 | 0 | 0 | 1 | 1 | 1 | 1 | 0 | 1 | 1 | 1 | 0 | 1 | 1 | 1 | 1 |
| 181 | 4.8750 | .1108 | 1 | 0 | 1 | 1 | 1 | 0 | 0 | 1 | 1 | 1 | 1 | 0 | 0 | 1 | 1 |
| 182 | 4.9333 | 1.1818 | 0 | 0 | 1 | 1 | 1 | 0 | 1 | 1 | 1 | 1 | 1 | 1 | 0 | 1 | 1 |
| 183 | 5.0000 | 1.3340 | 1 | 0 | 1 | 1 | 1 | 0 | 1 | 1 | 1 | 0 | 1 | 1 | 0 | 1 | 1 |
| 184 | 5.0833 | 1.6387 | 1 | 0 | 1 | 1 | 1 | 0 | 1 | 1 | 0 | 1 | 1 | 1 | 1 | 1 | 1 |
| 185 | 5.3333 | 4.6875 | 0 | 0 | 1 | 1 | 1 | 0 | 0 | 1 | 1 | 1 | 1 | 1 | 1 | 1 | 1 |
| 186 | 5.4286 | 1.7555 | 1 | 0 | 1 | 1 | 0 | 0 | 1 | 1 | 1 | 1 | 1 | 1 | 1 | 1 | 1 |
| 187 | 5.4783 | .9072 | 0 | 1 | 0 | 1 | 1 | 1 | 0 | 1 | 1 | 1 | 0 | 1 | 1 | 1 | 1 |
| 188 | 5.5000 | .3945 | 0 | 1 | 0 | 1 | 1 | 1 | 0 | 1 | 1 | 1 | 1 | 1 | 0 | 1 | 1 |
| 189 | 5.7333 | 4.0692 | 0 | 1 | 0 | 1 | 1 | 0 | 0 | 1 | 1 | 1 | 1 | 1 | 1 | 1 | 1 |
| 190 | 5.7500 | .2904 | 0 | 1 | 0 | 1 | 1 | 0 | 0 | 1 | 1 | 1 | 0 | 1 | 1 | 1 | 1 |
| 191 | 5.8333 | 1.4280 | 1 | 0 | 1 | 1 | 0 | 0 | 1 | 1 | 1 | 1 | 1 | 0 | 0 | 1 | 1 |
| 192 | 5.8750 | .7098 | 1 | 0 | 1 | 1 | 1 | 0 | 1 | 1 | 1 | 1 | 0 | 1 | 1 | 1 | 1 |
| 193 | 5.9130 | .6427 | 1 | 0 | 1 | 1 | 1 | 0 | 0 | 1 | 1 | 1 | 0 | 1 | 1 | 1 | 1 |
| 194 | 6.0000 | 1.4500 | 0 | 1 | 1 | 1 | 1 | 0 | 0 | 1 | 1 | 1 | 0 | 0 | 1 | 1 | 1 |
| 195 | 6.4000 | 6.2500 | 0 | 0 | 1 | 1 | 1 | 0 | 1 | 1 | 1 | 1 | 0 | 1 | 1 | 1 | 1 |
| 196 | 6.5000 | 1.5385 | 0 | 0 | 1 | 1 | 1 | 0 | 1 | 1 | 1 | 1 | 0 | 0 | 1 | 1 | 1 |
| 197 | 6.7500 | 3.7037 | 1 | 0 | 1 | 1 | 1 | 0 | 1 | 1 | 0 | 1 | 0 | 1 | 1 | 1 | 1 |
| 198 | 7.0000 | 3.5714 | 0 | 0 | 1 | 1 | 1 | 0 | 0 | 1 | 1 | 1 | 0 | 1 | 1 | 1 | 1 |
| 199 | 7.3333 | 4.5450 | 1 | 0 | 1 | 1 | 0 | 0 | 1 | 1 | 0 | 1 | 1 | 1 | 1 | 1 | 1 |
| 200 | 7.7500 | 5.3768 | 1 | 0 | 1 | 1 | 0 | 0 | 0 | 1 | 1 | 1 | 0 | 1 | 1 | 1 | 1 |
| 201 | 9.0000 | 13.8889 | 1 | 0 | 1 | 1 | 0 | 0 | 1 | 1 | 0 | 1 | 0 | 1 | 1 | 1 | 1 |

Fig. 3D

MESH NETWORK FOR LASER-TRIMMED INTEGRATED CIRCUIT RESISTORS

BACKGROUND OF THE INVENTION

1. Field of the Invention

The present invention relates to resistors fabricated on a substrate. In particular, the present invention is a mesh resistor network from which some resistor elements can be cut to select a desired resistance value.

2. Description of the Prior Art

Many analog and other integrated circuits require precise matching of the resistance values of resistors fabricated thereon to achieve desired overall circuit precision. The "natural" level of matching for integrated circuit resistors (i.e., that achievable by controlling parameters of the manufacturing process) is approximately 0.1–0.3%. For some circuits such as high-precision analog-to-digital and digital-to-analog converters, this degree of precision is inadequate. To produce such high-precision devices, various forms of post-fabrication trimming have been deviced to adjust the resistance value of one resistor of the matched pair. Known techniques include laser trimming or cutting, Zener-zapping, and metal-link cutting and blowing.

Other integrated circuits include individual resistors which must be trimmed to an absolute resistance value. In applications of these types, untrimmed accuracies on the order of only 15–20% are typical due to the wide manufacturing variations in sheet resistance of the integrated circuit.

Laser trimming involves the use of a laser to alter the shape of a resistor region and thereby bring its resistance to the desired value. "Top hat", "L-cut" and other trim patterns are commonly used.

Serious problems arise from aging and annealing effects resulting from this technique. The "partially zapped" material along the edge of the cut trim path often has different properties from undisturbed material, and its resistance ages (anneals) at a different rate than the body of the resistor. This can give rise to a situation where a resistor pair which initially trimmed to a precise ration exhibits a slow variation of the ratio due to aging effects. As a result, the circuit gradually drifts out of specification during usage.

To avoid aging problems, it is known to use a trimming geometry in which resistive links are either totally cut, or left undisturbed. The infinite resistance of a cut link is unaffected by aging. Known techniques which make use of this property include a set of resistive links which are connected in a parallel geometry. However, if N links are used, the resolution of the trim is only 1/N. Trim resolutions can be increased by using binary-weighted links with values in the ratios of 1, 2, 4, etc. A problem with these parallel-connected geometry arrangements is that although the spacing between conductance values is uniform, the spacing between resistance values is not.

Still another known approach for adjusting the resistance value of resistors on integrated circuits is one in which the resistive links are shorted by metal. The metal shorts are blown open with a current pulse or laser beam. Again, binary weighting offers advantages. One practical disadvantage of such schemes is that laser trimming of metal requires much higher power than for resistive films, tends to disrupt the chip passivation, and thereby creates reliability hazards.

Clearly, there is a continuing need for improved integrated circuit resistor networks and methods for selecting the resistance value thereof. The resistor network and method will preferably be applicable to both resistor matching applications, and the selection of absolute resistor values. The resistor network itself must be compact so as to utilize little space on the integrated circuit, permit a wide trim range (i.e., large Rmax/Rmin), and have a high resolution (i.e. small intervals between adjacent trimmed values). A network capable of providing resistance values uniformly spaced in resistance in also desirable. The network and method should also be capable of implementation using currently available technology.

SUMMARY OF THE INVENTION

The present invention is a resistor network which couples terminal leads on a substrate. The network includes a plurality of N-sided meshes. Each mesh is formed by N resistor elements linked at network nodes. N is greater than or equal to three. Some resistor elements can be cut or otherwise broken to select a desired resistance value of the network.

In one preferred embodiment, the resistor network includes a plurality of triangular meshes formed by three resistor elements. Another embodiment includes a plurality of square meshes formed by four resistor elements. Each of the resistor elements preferably has approximately the same resistance value. Various network patterns of cut resistor elements and their corresponding resistor values can be stored in memory. A laser operated under computer control can cut the resistor elements to produce networks having desired resistance values.

The mesh resistor network of the present invention can be easily fabricated on integrated circuits using known techniques. The mesh network permits a wide range of trim values, as well as a high resolution with uniformly spaced resistance values. It is equally applicable to both resistor matching and absolute value applications.

BRIEF DESCRIPTION OF THE DRAWINGS

FIG. 3 is a table illustrating possible resistance values which can be obtained from the resistor network shown in FIG. 1, and the corresponding patterns for producing these resistance values.

DETAILED DESCRIPTION OF THE PREFERRED EMBODIMENTS

Figure 1:
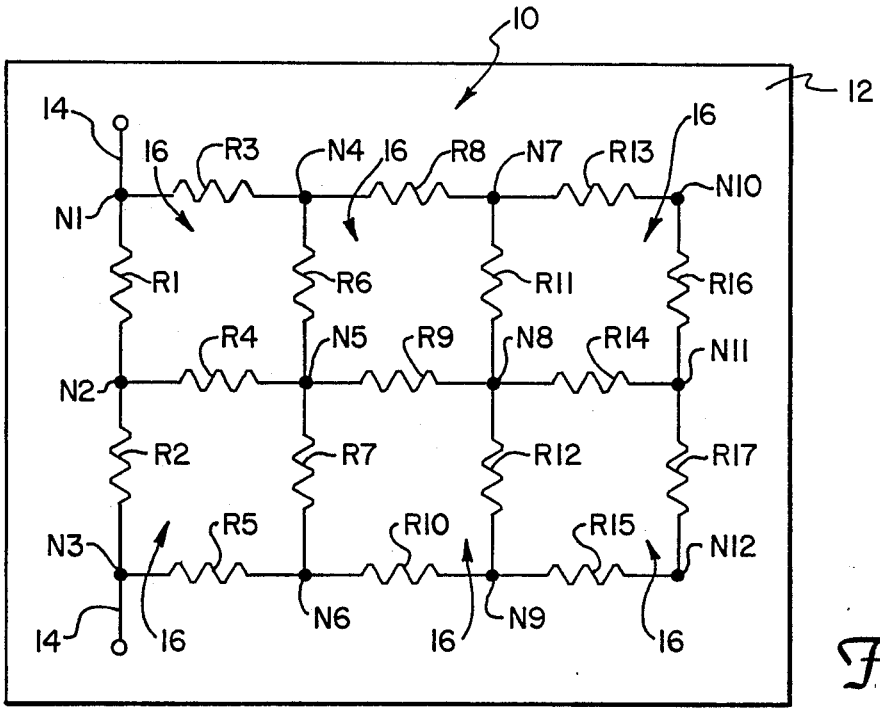
FIG. 1 is a schematic representation of an integrated circuit which includes a square mesh resistor network in accordance with the present invention.

A first embodiment of the present invention, square mesh resistor network 10, is shown schematically in FIG. 1. Resistor network 10 is fabricated on a substrate such as that of integrated circuit 12 and is coupled between other circuit elements (not shown) on the integrated circuit by terminal leads 14. As shown, resistor network 10 includes a plurality of resistor elements R1–R17 which are linked or coupled together at network nodes N1–N12 to form six four-sided meshes 16. Each mesh 16 includes four resistor elements.

Figure 2:
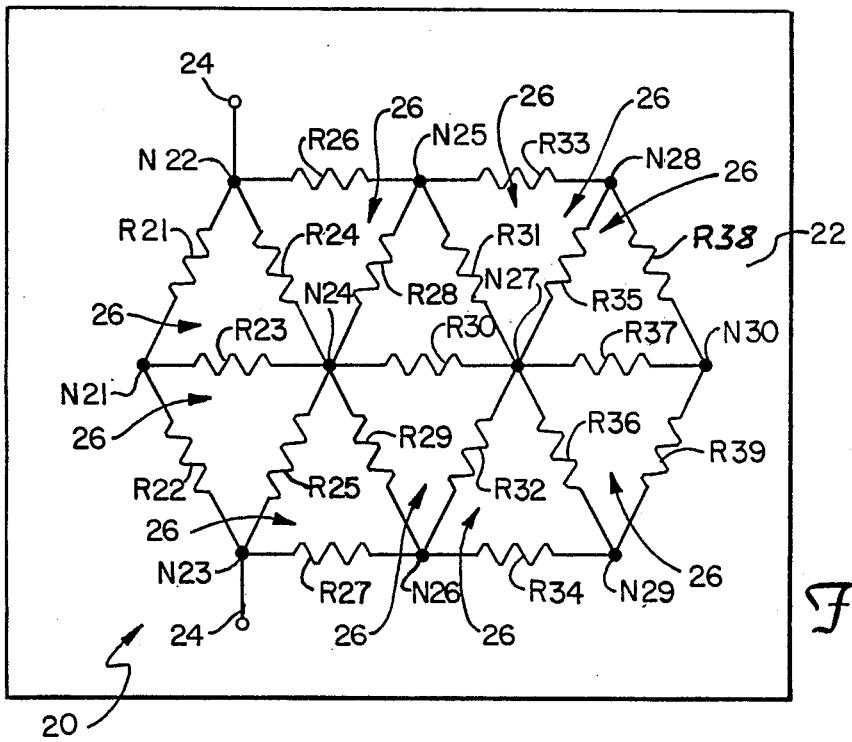
FIG. 2 is a schematic diagram of an integrated circuit which includes a triangular mesh resistor network in accordance with the present invention.

A second embodiment of the present invention, triangular mesh resistor network 20, is illustrated schematically in FIG. 2. Resistor network 20 is fabricated on a substrate such as that of integrated circuit 22 and is coupled or linked between other circuit elements (not shown) on the integrated circuit by terminal leads 24. As shown, resistor network 20 includes a plurality of resistor elements R21–R39 which are coupled or linked together at nodes N21–N30 to form ten three-sided meshes 26. Each mesh 26 includes three resistor elements. As is evident from FIGS. 1 and 2, each network node is linked to at least two adjacent nodes by resistor elements (e.g., node N12 of network 10 is linked to nodes N9 and N11 by resistor elements R15 and R17, respectively). Some of the network nodes are linked to at least three adjacent nodes (e.g., node N9 of network 10 is linked to nodes N6, N8 and N12 by resistor elements R10, R12 and R15, respectively). Meshes 16 and 26 can also be characterized as N-sided meshes of N resistor elements, where N is greater than or equal to three.

Resistor elements R1–R17 of network 10 and R21–R39 of network 20 are fabricated on their respective integrated circuits 12 and 22 through the use of any desired process which permits laser cutting, Zener-zapping, metal-link cutting or other post-fabrication technique by which the individual resistor elements can be electrically broken. In one preferred embodiment, the resistor elements are areas of resistive film sized to have the desired resistance value. Resistor elements R1–R17 and R1–R19 are fabricated on their respective integrated circuit 12 and 22 in such a manner that a laser can be used to cut through the resistor element or terminal coupling it to its nodes, thereby effectively removeing the resistor elements from the mesh network. By cutting selected resistors in this manner, a desired resistance value of networks 10 and 20 can be selected during post-fabrication processing of integrated circuits 12 and 22. In other embodiments, the resistor elements can be fabricated on a hybrid substrate of a monolithic chip using any desired technology.

To make use of resistor networks such as 10 and 20 described above it is necessary to establish a look-up table relating various patterns of cut resistor elements to the net resistance value of the network. To construct the look-up table, several factors can be kept in mind. Some patterns of cut resistor elements will result in open circuits and are therefore not useable. Also, due to the symmetry of mesh networks 10 and 20, many different patterns of cut resistor elements will correspond to a single resistance value. One approach to constructing the look-up table is to use group-theoretical methods to identify the unique cut patterns which are not equivalent by symmetry and then compute the network resistance for these patterns. A less elegant but equally accurate approach is to make an exhaustive search using some restrictions.

Using square mesh network 10 for purposes of example, the $2^{17}$ or 131,072 possible patterns of cut resistor elements R1–R17 can be limited by noting the following points:

1. If resistor elements R1 and R3 or R2 and R5 are both cut, the resistance of network 10 is infinite. Patterns which involve these permutations can be skipped.

2. Resistor elements R16 and R17 can be taken as never cut, since cutting resistor element R16 is equivalent to cutting resistor element R13, and cutting resistor element R17 is equivalent to cutting resistor element R15. This reduces the number of distinct patterns which can be fabricated from network 10 to 32,768.

3. Patterns with resistor element R1 cut and resistor element R2 uncut are symmetrically equivalent to those with resistor element R1 uncut and resistor element R2 cut. The same is true for resistor element pairs R6 and R7, R11 and R12, R8 and R10, R3 and R5, and R13 and R15.

4. If resistor element pairs R3 and R4, R3 and R5, or R4 and R5 are cut, the resistance of network 10 is always equal to the sum of the resistance of resistor elements R1 and R2, regardless of other resistor elements which are or are not cut.

5. In practice, patterns of network 10 which include large numbers of cut resistor elements are non-useful, so the number of possible patterns can be restricted to those which include six or less cut resistor elements.

A computer program which implements an algorithm using a relaxation method can be used to compute patterns and corresponding resistance values of network 10 for the look-up table. Voltage potentials at any given node can be replaced by the average of the potentials at adjacent nodes to which it is connected by uncut resistor element links. Although improved methods such as over relaxation can improve convergence speed, it has been found that for network 10 convergence to five decimal places can be obtained in fifty to one hundred iterations.

One of leads 14 is assumed to have a potential of 1 volt, and the other lead 14 a potential of 0 volts. The current through resistors R1 and R5 is then found from the converged node potential values. The resistance of network 10 between terminals 14 can be easily computed from these currents. The computed resistance values are then compared to a previous list of unique values, and recorded in the look-up table only if they are different than a previous pattern.

Assuming resistors R1–R17 of square mesh resistor network 10 have a unit resistor value of one ohm, 201 distinct resistance values ranging from 1.2381 to 9.0000 ohms can be obtained from resistor network 10. These resistance values and the corresponding cut pattern of network 10 are illustrated in FIG. 3. For each of these patterns, a "1" designates a resistor element which is uncut, and a "0" designates a resistor element which is cut. As illustrated in FIG. 3, between the resistance values of 1.2381 and 1.6000 ohms, there are no gaps greater than 2.6% between adjacent values. Good trim resolution can therefore be achieved using resistor network 10. A wide range of resistor values for absolute value trimming, as well as for adjustment of resistor ratios, is also possible. A finer resolution between resistance values can be obtained through the use of a larger mesh network than that shown in FIG. 1. The rapid increase in number and density of resistance values with network size suggests that only a small increase in network size would be needed to achieve resolution limited only by random variations in resistance value of the resistor elements.

Figure 4:
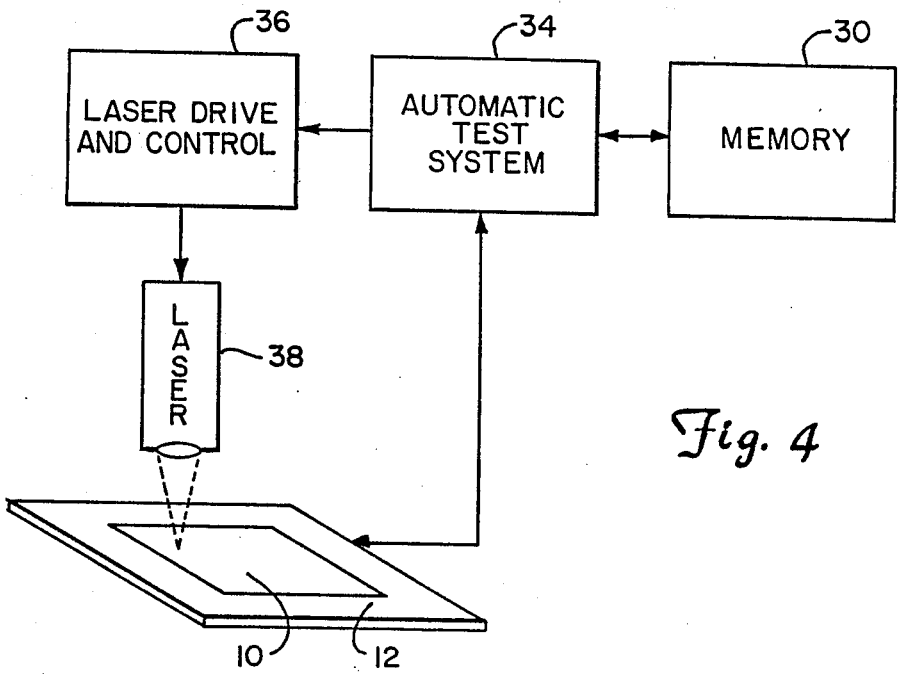
FIG. 4 is a block diagram representation of a system in accordance with the present invention by which desired resistance values on integrated circuits can be selected.

A system for selecting the resistance value of a mesh network 10 fabricated on an integrated circuit 12, and for cutting a pattern on the network which will produce that value, is illustrated generally in FIG. 4. A look-up table which includes data representing various trim patterns and their corresponding resistance value (such as that of FIG. 3) can be stored within memory 30.

Integrated circuit 12 is coupled to an automatic test system 34 which makes measurements of electrical properties such as gain and offset voltage of circuit elements (not separately shown) on the integrated circuit in its untrimmed state. In response to the measured electrical properties, automatic test system 34 computes the desired trimmed resistor value in accordance with a trim algorithm stored therein. Automatic test system 34 then searches memory 30 for a trim pattern which will provide the required resistance value. Data representative of the desired trim pattern is then provided to laser drive and control 36 by test system 34. In response, laser drive and control 36 positions laser 38 at desired positions over integrated circuit 12, and actuates the laser to produce a beam of radiation which will cut various resistor elements (not shown in FIG. 4) to produce the required trim pattern.

Although the present invention has been described with reference to preferred embodiments, workers skilled in the art will recognize that changes may be made in form and detail without departing from the spirit and scope of the invention. In particular, although the resistor elements have been described as thin film resistors fabricated on an integrated circuit (i.e., semiconductor) substrate, the resistor elements can be fabricated using any desired technology on any type of substrate.

What is claimed is:

1. A method for obtaining a desired resistance value between two terminal leads, including:

providing a resistor network which includes a plurality of N-sided meshes of N discrete resistor elements which couple two terminal leads, wherein N is greater than or equal to three;

storing data representative of patterns of broken resistor elements from the network and corresponding resistance values of the network; and permanently breaking resistor elements from the network as a function of the stored data so as to cause the network to have the desired resistance value.

2. The method of claim 1 wherein permanently breaking resistor elements includes severing resistor elements with a beam of radiation.

3. The method of claim 1 wherein permanently breaking resistor elements includes breaking resistor elements to create a pattern of broken resistor elements from the network corresponding to the desired resistance of the network.

4. The method of claim 1 and further including:

determining a desired resistance value of the resistor network; and accessing the stored data to determine a pattern of broken elements in the network corresponding to the desired resistance value of the network, before permanently breaking the resistor elements.

5. A method for adjusting electrical characteristics of an integrated circuit including:

providing an integrated circuit with a resistor network including a plurality of network nodes, wherein each network node is linked to at least two adjacent network nodes by discrete resistor elements, and some of the network nodes are linked to at least three adjacent network nodes by discrete resistor elements;

storing data representative of patterns of broken resistor elements in the network and corresponding resistance values of the network;

determining a desired resistance value of the resistor network;

accessing the stored data to determine a pattern of broken resistor elements in the network corresponding to the desired resistance value of the network; and permanently breaking resistor elements in the network as a function of the accessed data to cause the network to have the desired resistance value.

6. The method of claim 5 wherein permanently breaking resistor elements includes severing resistor elements with a beam of radiation.

* * * * *

UNITED STATES PATENT AND TRADEMARK OFFICE

CERTIFICATE OF CORRECTION

PATENT NO. : 4,782,320

DATED : November 1, 1988

INVENTOR(S) : John S. Shier

It is certified that error appears in the above-identified patent and that said Letters Patent is hereby corrected as shown below:

On the front page of the patent, in the References Cited section, under U.S. PATENT DOCUMENTS, please insert the following references:

| | | | | |
|---|---|---|---|---|
| -- | 4,580,030 | 4/1986 | Takeuchi | 219/121 |
| | 4,539,622 | 9/1985 | Akasaki | 361/401 |
| | 4,468,652 | 8/1984 | Wang et al. | 340/347 |
| | 4,459,580 | 7/1984 | Furukawa | 340/347 |
| | 4,412,241 | 10/1983 | Nelson | 357/51 |
| | 4,381,441 | 4/1983 | Desmarais et al. | 219/121 |
| | 4,306,246 | 12/1981 | Davies et al. | 357/36 |
| | 4,215,333 | 7/1980 | Huang | 338/322 |
| | 4,210,996 | 7/1980 | Amemiya et al. | 29/610 |
| | 4,150,366 | 4/1979 | Price | 340/347 |
| | 4,138,671 | 2/1979 | Comer et al. | 340/347 |
| | 4,031,272 | 6/1977 | Khanna | 427/96 |

UNITED STATES PATENT AND TRADEMARK OFFICE

CERTIFICATE OF CORRECTION

PATENT NO. : 4,782,320

DATED : November 1, 1988

INVENTOR(S) : John S. Shier

It is certified that error appears in the above-identified patent and that said Letters Patent is hereby corrected as shown below:

| | | | |
|---|---|---|---|
| 4,586,019 | 4/1986 | Brokaw | 338/195 |
| 4,565,000 | 1/1986 | Brokaw | 29/611 --. |

Signed and Sealed this

Fourth Day of April, 1989

*Attest:*

*Attesting Officer*

DONALD J. QUIGG

*Commissioner of Patents and Trademarks*